US008525751B1

(12) United States Patent
Josypenko

(10) Patent No.: US 8,525,751 B1
(45) Date of Patent: Sep. 3, 2013

(54) TAPERED DIRECT FED BIFILAR HELIX ANTENNA

(75) Inventor: Michael J. Josypenko, Norwich, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 250 days.

(21) Appl. No.: 13/194,382

(22) Filed: Jul. 29, 2011

(51) Int. Cl.
*H01Q 1/36* (2006.01)

(52) U.S. Cl.
USPC ..... 343/895

(58) Field of Classification Search
USPC ..... 343/821, 859, 895
See application file for complete search history.

(56) References Cited

U.S. PATENT DOCUMENTS

| | | | | |
|---|---|---|---|---|
| 6,018,326 | A * | 1/2000 | Rudisill | 343/895 |
| 7,372,427 | B2 * | 5/2008 | Leisten | 343/895 |
| 8,207,905 | B2 * | 6/2012 | Leisten et al. | 343/895 |
| 2010/0045562 | A1 * | 2/2010 | Drake et al. | 343/860 |

* cited by examiner

*Primary Examiner* — Tan Ho
(74) *Attorney, Agent, or Firm* — James M. Kasischke; Jean-Paul A. Nasser; Michael P. Stanley

(57) ABSTRACT

A tapered direct fed bifilar helix antenna comprises bifilar antenna elements which helically spiral around an antenna axis to define an outer cylindrical shape of the direct fed bifilar helix antenna. The width of the bifilar antenna elements at the feed end of the antenna is sized to provide the antenna with an approximately fifty ohm characteristic impedance. The individual filar elements taper at a predetermined axial position from a maximum width at the feed end to a minimum width at the end furthest from the feed end. A fifty ohm coaxial cable directly feeds the tapered bifilar antenna elements.

8 Claims, 3 Drawing Sheets

TAPERED DIRECT FED BIFILAR HELIX ANTENNA

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

This patent application is co-pending with a related patent application entitled DIRECT FED BIFILAR HELIX ANTENNA (Navy Case No. 83514), by Michael J. Josypenko the same named inventor to this application.

BACKGROUND OF THE INVENTION (1) Field of the Invention

The present invention relates generally to broadband antennas and, more particularly, to a direct fed, rugged bifilar helix antennas.

(2) Description of the Prior Art

Broadband helical antennas utilized for satellite communications bands may be mounted on the mast of a surface vessel for wideband satellite communications. Satellite communications may include Demand Assigned Multiple Access (DAMA) UHF satellite communications.

U.S. Pat. No. 6,246,379, to the present inventor, which is briefly discussed hereinafter, provides a quadrifilar antenna suitable for broadband satellite communications that is of moderate size, moderate weight, rugged, and does not require matching networks. Above a cut-in frequency, antennas of the type described in U.S. Pat. No. 6,246,379 have a broadband, approximately constant resistive impedance equal to approximately the characteristic impedance ($Z_0$) value of the antenna, resulting in a low voltage standing wave ratio (VSWR) about the antenna $Z_0$. By making the antenna elements as wide as practically possible before they overlap, the application antenna reduces the value of $Z_0$ to a practical lowest limit of 100 ohms, which feeds very well into the $Z_0$ of 100 ohms between the two center conductors of a 180 degree power splitter feeding a given bifilar. Thus the resultant antenna of two crossed bifilar helixes has a 50 ohm 90 degree power splitter feeding two 50 ohm 180 degree power splitters feeding their two 100 ohm outputs directly into the two crossed bifilar helixes making up the quadrifilar helix. There are no matching networks. The antenna is directly fed via its power splitter feed network.

Detailing the construction of the antenna, U.S. Pat. No. 6,246,379 discloses a quadrifilar helix antenna that includes a base portion for containing a feed network including a power input, a 90 degree power splitter in communication with the power inlet, and first and second 180 degree power splitters in communication with the 90 degree power splitter. A support tube is mounted on the base portion, and a plurality of disk separators are mounted on the tube. Four elongated filar elements are wound around the tube and are spaced therefrom by the disk separators. The elements are connected to end-most lower and upper ones of the disk separators; the elements extending toward a center feed point of the upper disk separator. First and second radially opposite pairs of feed cables are wound around and connected to the centers of the elements, extending from the lower disk separator to the upper disk separator, to function as an infinite balun. At the lower disk separator, the cables are introduced onto the antenna at the lower ends of the elements where both the ends and cables are shorted together. At the upper disk separator, the cables are opened up to feed the upper ends of the elements. A given radially opposite pair of cables feed the radially opposite elements of a given bifilar element pair. Thus a given 180 degree power splitter feeds a given bifilar pair of elements.

In a co-pending patent application entitled DIRECT FED BIFILAR HELIX ANTENNA (Navy Case No. 83514), by Michael J. Josypenko, the same named inventor to this application, there is a description of how the broadband impedance properties of quadrifilar helixes can also be applied to bifilar helix antennas, since the quadrifilar helix is an array of two crossed bifilar helixes. As derived in the application, the difference in the impedance from the quadrifilar design of two crossed bifilars to the single bifilar is that when changing from two crossed bifilars to a single bifilar, with the width of a bifilar element being the combined widths of the two quadrifilar elements it replaces, $Z_0$ is halved to approximately 50 ohms. The result is a bifilar helix that is fed directly from a 50 ohm coaxial line that uses the antenna as an infinite balun to reach the feed point of the antenna. For an antenna of 50 ohms, the constant width of the antenna elements are at a practical maximum of the space available for an element. A difference between the quadrifilar helix and bifilar helix antenna is that the bifilar antenna must always be fed in back fire mode and must be long enough to be a traveling wave antenna before unidirectional patterns of cardioid shape occur off of the fed end of the antenna, and therefore it may be required to be longer than the quadrifilar helix antenna.

U.S. Pat. No. 6,288,686, issued Sep. 11, 2001, to the present inventor, M. Josypenko, discloses a tapered direct fed quadrifilar helical antenna having a feed point for the antenna connecting to individual helical antenna elements. Each antenna element tapers from a maximum width at the feed point to a minimum width. The tapered antenna elements provide impedance transformation. The antenna produces a cardioid pattern that corresponds to antennas having constant width antenna elements. The elements of the tapered direct fed quadrifilar are made narrower and lighter than an untapered quadrifilar by applying the principle of matching two impedances with a half wavelength tapered transmission line. A given two elements of a bifilar of the antenna are tapered to become a radiating tapered transmission line, matching the input impedance of 100 ohms at the feed point where the elements are of maximum width to a higher impedance at least one half wavelength down the elements where the elements have been tapered down to be much narrower. The advantage of narrower elements is reduced weight of and amount of material required for the antenna.

Accordingly, the above cited prior art does not disclose a less complex antenna that occupies a small diameter (e.g., 0.1 to 0.3 wavelengths) and that avoids the need for power splitters or matching networks, requires only one feed cable, and provides a simplified design with only two antenna elements.

SUMMARY OF THE INVENTION

An object of the present invention is to provide an geometrically improved wideband satellite communication antenna.

Another object of the present invention is to provide a less complex construction for a wideband satellite communication antenna.

Yet another object of the present invention is to utilize only one feed cable and eliminate the need for power splitters and matching networks.

Yet another object of the present invention is to provide a direct fed 50 ohm broadband antenna.

Accordingly, the present invention comprises a direct fed bifilar helix antenna, which comprises bifilar antenna elements. Each of the bifilar antenna elements comprises an outer planar surface portion which helically spirals around an antenna axis to define an outer cylindrical shape of the direct fed bifilar helix antenna. The bifilar antenna elements further comprise a pair of planar end surface portions at a feed end of the direct fed bifilar helix antenna.

A feed point is positioned along the antenna axis at the feed end of the direct fed bifilar helix antenna. The feed end of the direct fed bifilar helix antenna is entirely covered by the pair of planar end surface portions of the bifilar antenna elements except for a first gap between the pair of planar end surface portions.

A shorting element electrically shorts the bifilar antenna elements together at an opposite end of the direct fed bifilar helix antenna from the feed end.

A single 50 ohm coaxial cable comprises a center conductor and an outer conductor, which electrically connect to the pair of planar end surface portions at the feed point. The 50 ohm coaxial cable is routed along the outer cylindrical shape of the direct fed bifilar helix antenna in a helical path that follows and whose outer conductor is connected to one of the bifilar antenna elements to the opposite end of the antenna from the feed end.

In one possible embodiment, the coaxial cable is routed away from the opposite end from a point on the antenna axis via the shorting element.

The outer planar surface portion of the bifilar antenna elements covers all of the outer cylindrical shape of the direct fed bifilar helix antenna except for a second and a third gap between the bifilar antenna elements. The first gap connects with the second and third gaps.

The width of the second and third gaps varies with an axial position of the second and third gaps along the direct fed bifilar helix antenna. The width of the second and third gaps is equal to the width of the first gap at the feed end of the direct fed bifilar antenna, and increases with increasing distance from the feed end until reaching a maximum width. The maximum width of the second and third gaps occurs at least one-half wavelength away from the feed end.

The present invention also comprises a method for making a direct fed bifilar helix antenna. The method comprises steps such as providing bifilar antenna elements an outer planar surface portion that helically spirals around the antenna axis. Other steps comprise providing that the bifilar antenna elements comprise a pair of planar end surface portions at the feed end. The method comprises providing a feed point which is at the feed end of the direct fed bifilar helix antenna and providing that the feed end of the direct fed bifilar helix antenna is entirely covered by the pair of planar end surface portions except for a first gap between the pair of planar end surface portions.

Other steps comprise providing a shorting element, which electrically shorts the bifilar antenna elements together at an opposite end of the direct fed bifilar helix antenna from the feed end. The method further comprises electrically connecting a single 50 ohm coaxial cable to the pair of planar end surface portions at the feed point and routing the 50 ohm coaxial cable along the outer cylindrical shape of the direct fed bifilar helix antenna in a helical path that follows and whose outer conductor is connected to one of the bifilar antenna elements to the opposite end of the antenna from the feed end.

In one embodiment, the method comprises routing the coaxial cable away from the opposite end from a point on the antenna axis, via a short across the ends of the elements.

The method comprises providing that the outer planar surface portion of the bifilar antenna elements covers the outer cylindrical shape of the direct fed bifilar helix antenna except for a second and third gap between the bifilar antenna elements and that the first gap connects with the second and third gaps.

The method comprises providing that the second and third gaps comprise a width that varies with an axial position of the second and third gaps along the direct fed bifilar helix antenna. The second and third gaps may be equal in width to the first gap at the feed end and increase with increasing distance from the feed end until reaching a maximum width. The method comprises providing that the maximum width of the second and third gaps occurs at least one-half wavelength away from the feed end.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DETAILED DESCRIPTION OF THE INVENTION

Figure 1A:
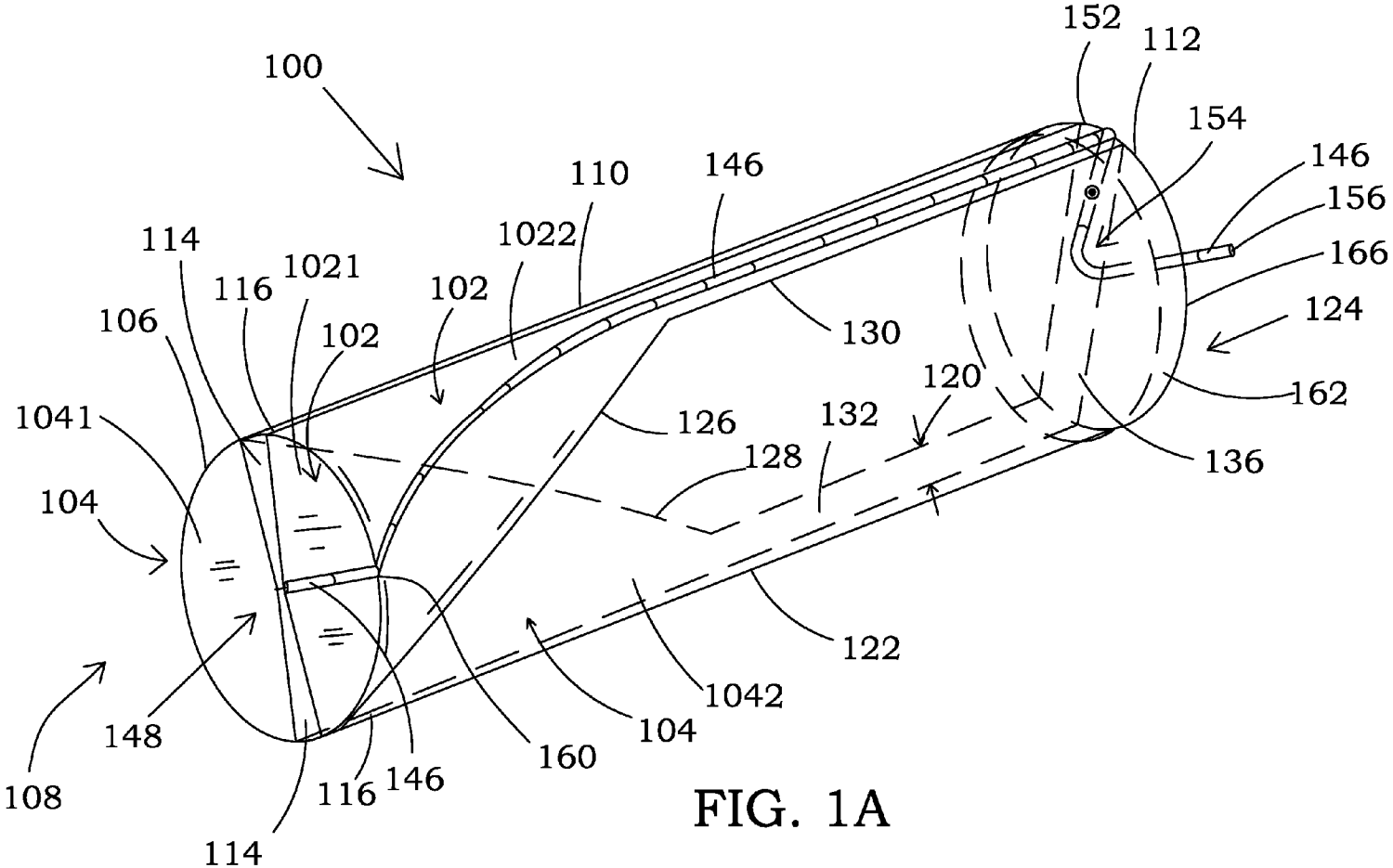
FIG. 1A is a perspective view, partially in hidden lines, of a direct fed bifilar antenna with variable width bifilar antenna elements unpitched in accord with one possible embodiment of the invention.
Figure 1B:
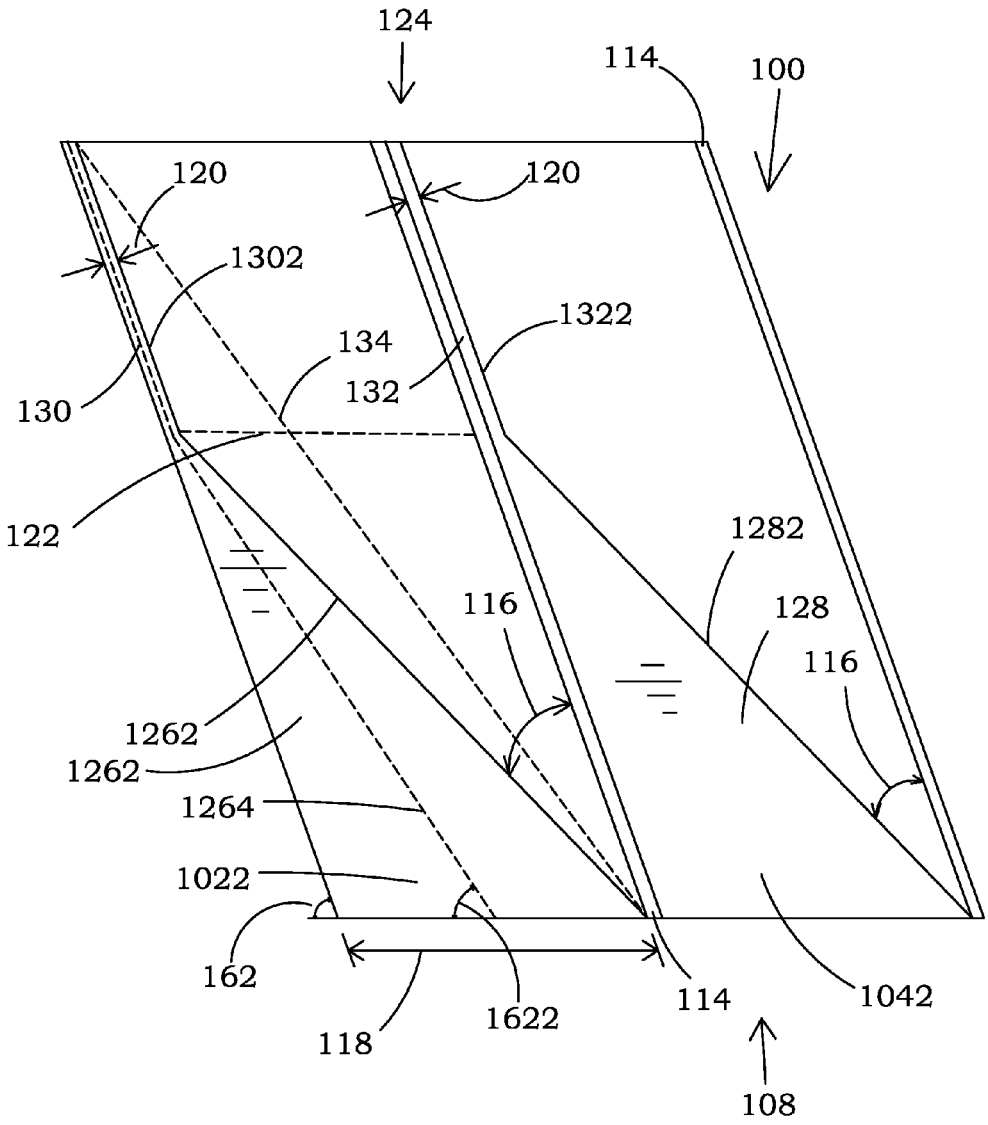
FIG. 1B is an unwrapped flat view of the bifilar antenna of FIG. 1A.

In the preferred embodiment of a tapered direct fed bifilar antenna, shown as antenna 100 in FIGS. 1A and 1B, bifilar elements 102 and 104 are tapered rather than have a constant almost maximum width. The taper goes from the almost maximum width near the feed end of the antenna to a much narrower width along a minimum bifilar element length section of ½ wavelength, as discussed hereinafter.

FIG. 1A and FIG. 1B show an embodiment of antenna 100, which comprises tapered bifilar elements 102 and 104. FIG. 1A shows the actual cylindrical shape of antenna 100. FIG. 1B shows the circumferential cylindrical part of antenna 100 unrolled into a flat shape, to allow easier visualization of the circumferential cylindrical parts 1022 and 1042 of bifilar antenna elements 102 and 104, and possible variations thereof.

In FIG. 1A, bifilar elements 102 and 104 comprise a pitch angle of 90 degrees (parallel to antenna axis), to provide easier visualization of the antenna parts. More typically, bifilar elements 102 and 104 helically wrap about the antenna cylinder at a lower pitch angle 162, as shown for their circumferential sections 1022 and 1042 in FIG. 1B.

In FIG. 1A, antenna 100 may comprise insulated supporting parts such as support disc 106 at feed end 108, support cylinder 110, and support disc 112 at end 124. As compared to constant, almost maximum width bifilar elements, bifilar elements 102 and 104, which are the metallic elements of antenna 100, are narrower and have more difficulty supporting themselves without these supporting parts.

At feed end 108 of antenna 100, where support disc 106 is located, bifilar elements 102 and 104 comprise planar, preferably flat, radial end sections 1021 and 1041 that cover most of disc 106, except for a small gap 114 that separates them. Bifilar elements 102 and 104 continue onto cylinder 110 as circumferential sections 1022 and 1042, separated by gap 116, shown in FIG. 1B. Bifilar elements 102 and 104 preferably helically wrap about the cylinder length at a desired pitch angle 162, as discussed hereinbefore. The cardioid broadcast/reception pattern becomes broader as the pitch angle increases. If the electrical lengths of bifilar elements 102 and 104 become too long, and the pitch angle is large, e.g., roughly greater than or equal to forty degrees, then the pattern will start to split overhead on axis.

Gap 116 starts out actually as two gaps separating the elements, and as the same width as gap 114 at the feed end of the antenna. Its width increases along the axial length of bifilar element's 102 and 104 sections 1022 and 1042 as they taper while progressing axially along cylinder 110 toward end 124. The bifilar element sections taper from a maximum width 118, which are approximately all of the width available, e.g., 98.5%. The maximum width of bifilar element sections 1022 and 1042 at feed end 108 corresponds to an approximately 50 ohm characteristic impedance. Some adjustment of this width may be necessary in order to accommodate such factors such as small characteristic impedance dependence on pitch angle and element thickness.

The width of bifilar element circumferential sections 1022 and 1042 of bifilar elements 102 and 104 decreases from the maximum width as indicated as 118 to a chosen minimum width 120 (which corresponds to an impedance appreciably greater than 50 ohms). In this embodiment, minimum width 120 of bifilar elements 102 and 104 begins at axial position 122. The width of the bifilar elements then remains constant at the minimum width 120 along the axial length of antenna 100 until reaching end 124. The electrical length of bifilar elements 102 and 104 between axial position 122 and feed end 108 is at least ½ wavelength.

Thus, in this embodiment, bifilar elements 102 and 104 form respective tapered sections 126 and 128 with respective tapered edges 1262 and 1282. The rest of the elements from position 122 to their ends at 124 as sections 130 and 132 are of constant width and have respective constant width edges 1302 and 1322.

In an alternative embodiment, the bifilar elements can taper from feed end 108 down to the minimum width at a position which may be at any axial position between 122 and end 124, e.g., greater than ½ wavelength from feed end 108. For example, dashed line 134 in FIG. 1B represents a tapered edge, which tapers smoothly to end 124 of antenna 100. In this example, edge 134 would be formed instead of edges 1262 and 1302 on bifilar element circumferential section 1022.

Other tapers than the linear or straight-line tapers shown in FIG. 1A and FIG. 1B are possible. Moreover, the taper does not need to occur only on one side of the bifilar elements. The taper can occur on both sides of the bifilar elements to produce an element that is symmetrical about its center 1264. What is important is that the tapered section of the bifilar elements is at least ½ wavelength long, and that the taper begins from the maximum width to a minimum width.

The tapered section of the bifilar elements acts as a ½ wavelength tapered transmission line transformer, matching the approximately 50 ohms characteristic impedance of the wide end of the bifilar elements to whatever the higher $Z_0$ of the thinner section of the bifilar elements may be.

Figure 2:
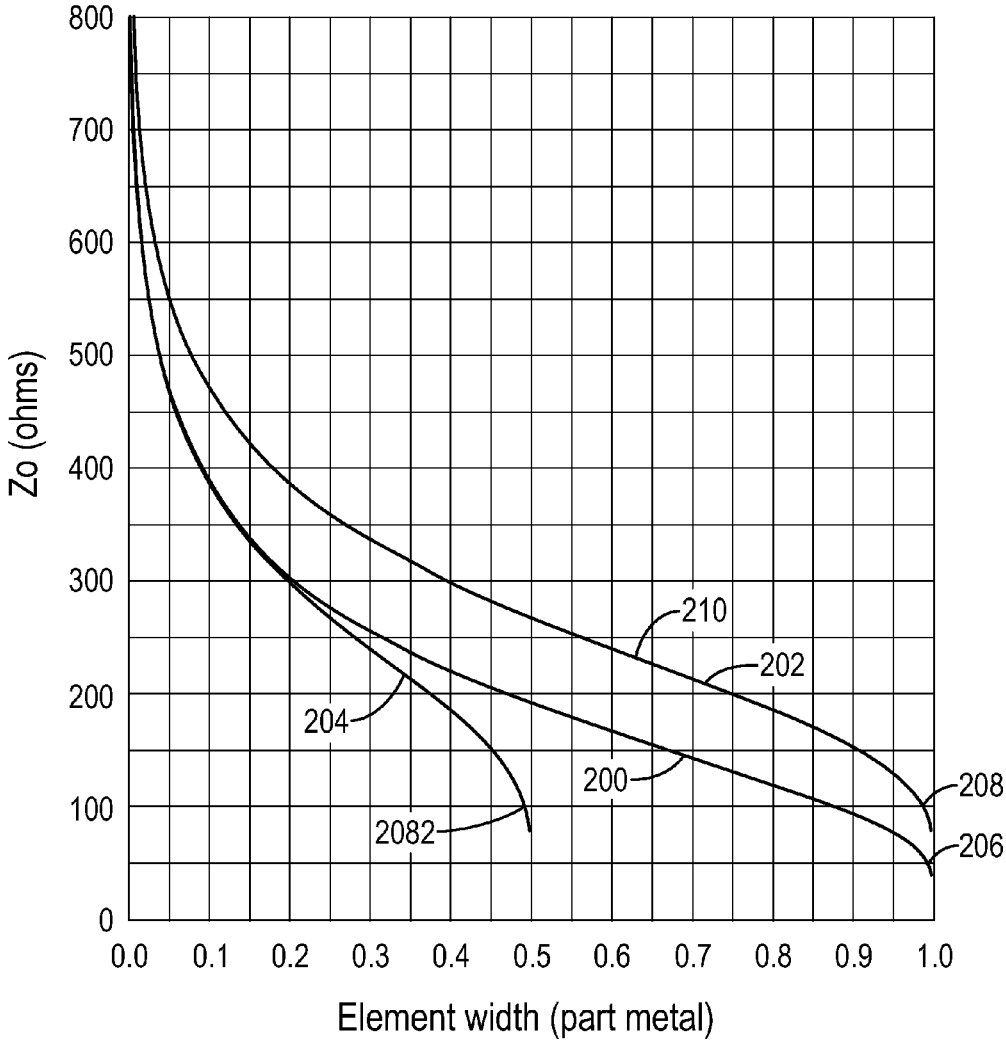
FIG. 2 is a graph showing the dependence of the characteristic impedance of the cylindrical part of the bifilar elements of a bifilar and quadrifilar helix on the element circumferential width, for the case of zero thickness elements at a pitch angle of 90 degrees.

To show in detail the behavior of the $Z_0$ of the bifilar elements, the cylindrical parts of the bifilar elements 1022 and 1042 versus element circumferential width was modeled to calculate their $Z_0$ for the extreme antenna case of zero thickness elements at a pitch angle of 90 degrees, as shown in FIG. 2. In the figure, curve 200 shows $Z_0$ as a function of element width in part of the available space (180 degrees of antenna circumference, which corresponds to the maximum element width of one). As can be seen, the elements need to be almost 100% wide for the impedance to lower enough for 50 ohms, which is used at the feed end of the antenna. For narrower widths, $Z_0$ increases significantly. Two extreme cases are also seen. Since $Z_0=\sqrt{L/C}$, where L is inductance per unit length of element and C is capacitance per unit length of element, when the element width is zero, the capacitance between elements is zero, inductance of zero width elements increases to infinity, and thus $Z_0$ goes to infinity. When the element width is 100% (one), the distance between parts of the elements on both sides of the gap goes to zero resulting in the capacitance between these parts going to infinity and $Z_0$ going to zero. Near this extreme $Z_0$ is changing quickly with gap width and the case of $Z_0$=50 ohms is found at point 206. Thus small changes in the gap width can be used to adjust for an accurate antenna input impedance of 50 ohms. Note there is a small error in this region of the plot, since the modeling segments near such a small gap needs to be significantly smaller than normal to allow accurate calculation of the high capacitance in this region. For a simple try, the sine function from 90 to 270 degrees was used to adjust segment widths across the width of an element.

Curve 202 shows the case when the antenna is a quadrifilar helix instead of a bifilar helix, with the available space for an element being 90 degrees (which corresponds to the maximum element width of one) instead 180 degrees of antenna circumference, since there are now four helix elements. This curve shows the $Z_0$ of the quadrifilar helixes of the prior art quadrifilar helixes of U.S. Pat. No. 6,246,379 and U.S. Pat. No. 6,288,686. Point 208 shows that when the elements are approximately 98.5% wide, the $Z_0$ is 100 ohms that is the $Z_0$ at the feed end of the antennas. When comparing point 208 to point 206, it can be seen that at approximately an element width of 98.5%, the bifilar helix $Z_0$ is approximately half at 50 ohms, which was derived in the patent application entitled DIRECT FED BIFILAR HELIX ANTENNA (Navy Case No. 83514). The higher $Z_0$'s of narrower element widths can be the $Z_0$'s along the tapered section and the narrow end section of the elements of the tapered quadrifilar helix of U.S. Pat. No. 6,288,686.

Curve 204 shows curve 202 redrawn from the viewpoint that a given bifilar helix element pair of the quadrifilar helixes could occupy 180 degrees (which corresponds to the maximum element width of one) instead of 90 degrees of antenna circumference. Physically, the pair can only occupy only 90 degrees due to the presence of the other bifilar pair, and thus the curve extends only to an element width of 0.5. The purpose of the curve is to show the effect of the other pair of bifilar helix elements on the $Z_0$ of the first bifilar element pair. This is done by comparing the curve to the $Z_0$ curve 206 of the bifilar helix, which only has one pair of bifilar elements. When comparing the two curves, it can be seen that when the quadrifilar helix bifilar element pair width is less than 0.25 of the width available (180 degrees) for the bifilar helix elements, its impedance is almost identical to the bifilar helix. This shows there is very little coupling between the two bifilar helixes of the quadrifilar helix. At above 0.25 of the width available, significant difference is seen between the two curves—the $Z_0$ of the quadrifilar helix bifilar drops significantly until at 0.5 of the width available, it is zero. This is due to significantly increased coupling to the second bifilar element pair, to the point where the second bifilar is effectively shorting out the first bifilar to a $Z_0$ of zero. This is also the mechanism that allows the bifilar helixes of the quadrifilar helixes of U.S. Pat. No. 6,246,379 and U.S. Pat. No. 6,288,686 to have a feed end impedance of 100 ohms, seen at points 208 and 2082.

The case of an extreme pitch angle of 90 degrees was chosen because it was the easiest to model. Normally, the pitch angle of a bifilar helix is lower than this value. Lower pitch angles will result in narrower and longer elements of increased inductance, resulting in some increase in $Z_0$. For example, with the Standard Antenna quadrifilar helix of U.S. Pat. No. 6,407,720, from column 7, line 62 to column 8, line 17, the pitch angle is a normal 66.64 degrees and the element width is 0.615. The $Z_0$ with some dielectric loading from the thin support tube and with a short flared radial section is almost 300 ohms. As opposed to this, curve 202 of FIG. 2 shows the calculated $Z_0$ of a 90 degree quadrifilar helix of 0.615 wide elements to be lower at 234 ohms at point 210.

To maintain patterns similar to an equivalent constant width bifilar helix antenna of constant pitch angle, elements symmetrically tapered about their centers may be preferable, since the pitch angle of the center of a bifilar element with symmetrically tapered elements is constant. As opposed to this, for the unsymmetrical elements shown in FIG. 1B, the pitch angle of the center of the constant width section 130 of the bifilar element 102 is 162, but the pitch angle of the center of the tapered width section 126 of bifilar element 102 reduces to 1622.

The material of bifilar elements 102 and 104 is thin low loss metal, such as copper or silver. At end 124 of cylinder 110, bifilar elements 102 and 104 are shorted by metallic strip 136, which is mounted on support disk 112. Metallic strip 136 may also have a width equal to width 120, which matches the width of bifilar elements 102 and 104 at end 124.

Alternately, the short can be a metal disk that is mounted onto or supplants support disk 112. As another alternative, a shorting ring 164 could be placed on the circumference of cylinder 110. However, the shorting ring is not the best alternative, because the shorting ring results in the feed cable exiting antenna 100 at an approximate rf=0 point that is off of the axis of antenna 100. The shorting ring lies off the axis and has finite inductance, because the ring has finite length (the circumference) and does not have an infinite width.

It is desirable for feed cable 146 to exit (or enter depending on the viewpoint) antenna 100 at an rf=0 point that is at a symmetrical point on the antenna, e.g., a point somewhere on the axis of antenna 100.

The width of the gaps 114 and 116 is what is left over of the total antenna circumference from the widths of bifilar elements 102 and 104. Antenna 100 is fed at the midpoints of the elements, on the planar end sections 1021 and 1041 of 102 and 104, on the axis of antenna 100, at feed point 148. At feed point 148, the center conductor of 50 ohm coaxial cable 146 is electrically connected to bifilar element 104. The inside of the outer conductor is electrically connected to bifilar element 102.

Referring to FIG. 1A, coaxial cable 146 is routed from the center of bifilar element 102 at feedpoint 148 radially outwardly to the edge of the antenna circumference as indicated at 160. Coaxial cable 146 then follows the center of bifilar element 102 toward end 124 of antenna 100. At the antenna circumference as indicated at 152, at end 124 of antenna 100, bifilar element 102 stops. From the circumference as indicated at 152, coaxial feed cable 146 follows metallic strip 136 on support disk 112 to center exit position 154, which is at an rf=0 point.

The outside of the outer conductor of the whole length of coaxial cable 146 from feed point 148 to center exit position 154 is connected to bifilar helix element 102 and shorting strip 136. Thus the whole length of coaxial cable 146 from feed point 148 to center exit position 154 is an infinite balun, which allows coaxial feed cable 146 to be introduced onto antenna 100 at 154 and connect to feed point 148. At center exit position 154, coaxial cable can leave antenna 100 as a section of cable, which will be connected to power when antenna 100 is mounted. RF can then conveniently be applied to the antenna at 156. The main beam of the pattern of antenna 100 will come off of the feed end 108.

If a metal disk is used to short the bifilar antenna elements at end 124, then the cable still leaves the antenna at center exit position 154, which lies on the axis of the antenna.

If a circumferential shorting ring 164 is used to short the bifilar elements at end 124, then coaxial cable 146 would follow half of the shorting ring from point 152 to point 166 and then leave the antenna at the circumference edge as indicated at 166. This is not the best method of feeding the antenna, since the cable does not leave the antenna at a symmetrical rf=0 point. To make the ring function as much as a short as possible, it should be made as wide as possible.

Accordingly, a less complex and lighter antenna suitable for satellite communications is shown herein, which has only two antenna elements in the configuration of tapered filars and only one feed cable. Moreover, because the characteristic antenna input impedance is approximately 50 ohms, the antenna can be directly fed with a 50 ohm coaxial cable without the need for a matching network.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. A helix antenna comprising:

a cylindrical support tube of dielectric material having a first end that serves as the feed end of the antenna and a second end;

a first support disc of dielectric material joined to the first end of the cylindrical support tube;

a second support disc of dielectric material joined to the second end of the cylindrical support tube;

a first elongated filar element and a second elongated filar element, wherein each of said filar elements comprise an outer planar surface portion and a planar end surface portion, wherein said feed end is entirely covered by each of said planar end surface portions of each of said filar elements except for a gap between each of the planar end surface portions, wherein both elongated filar elements are wound around said cylindrical support tube in a radially opposite, helical arrangement at a predetermined pitch angle relative to an axis of the cylindrical support tube such that the outer planar surface portion of each filar element covers the entire circumference and surface area of a portion of the cylindrical support tube with the exception of a gap separating the two elongated filar elements, wherein the first and second elongated filar elements taper at a specific axial position along the cylindrical support tube from a maximum width to a predetermined minimum width that corresponds to a desired minimum input impedance and a maximum antenna impedance wherein the gap separating the first and second elongated filar elements increases as the filar elements taper with increasing distance from the feed end until the gap reaches a maximum width, said maximum width occurs at least one-half wavelength along the element's length away from said feed end, said first and second elongated elements and cylinder support tube being supported at the cylinder support tube ends by said first support disc at the first end of the cylindrical support tube and by said second support disc at the second end of the cylindrical support tube;

an electrically conducting metal shorting strip, wherein the electrically conducting metal shoring strip joins the first elongated filar element and the second elongated filar element at the end of their respective tapered ends; and a coaxial feed cable having a center conductor joined to the planar end surface portion of the first elongated filar, and the inside of an outer conductor joined to the planar end surface portion of the second elongated filar element, wherein the coaxial feed cable is joined to the antenna at a feed point on the axis of said antenna, wherein the coaxial feed cable is wrapped around the length of the antenna positioned at and whose outer conductor is connected to the center of the second elongated filar element continuing to a center of the second support disc which is a radio frequency zero point and then beyond the radio frequency zero point for a predetermined length, such that the entire coaxial feed cable path from the feed point to the center of the conducting metal disc is an infinite balun.

2. The helix antenna of claim 1, wherein the first elongated filar element and the second elongated filar element are made of a low loss conductive metal such as copper or silver.

3. The helix antenna of claim 1, wherein the coaxial feed cable is a 50 ohm coaxial feed cable.

4. The helix antenna of claim 1, wherein the feed point of the antenna where the antenna is joined to the 50 ohm coaxial feed cable is located at the midpoints of each of the planar end surface portions the first elongated filar element and the second elongated filar element on the axis of the antenna.

5. The helix antenna of claim 1, wherein the electrically conducting metal shorting strip is replaced by an electrically conducting metal disc positioned on the second support disc that functions as a short between the first elongated filar element and the second elongated filar element.

6. A method for making a tapered direct fed bifilar helix antenna, comprising:

providing bifilar antenna elements which each comprise an outer planar surface portion that helically spirals around an antenna axis to define an outer cylindrical shape of said tapered direct fed bifilar helix antenna;

providing that said bifilar antenna elements further comprise a pair of planar end surface portions at a feed end of said tapered direct fed bifilar helix antenna;

providing a feed point which is positioned along said antenna axis at said feed end of said tapered direct fed bifilar helix antenna;

providing that said feed end of said tapered direct fed bifilar helix antenna is entirely covered by said pair of planar end surface portions of said bifilar antenna elements except for a first gap between said pair of planar end surface portions;

providing a shorting element which electrically shorts said bifilar antenna elements together at an opposite end of said tapered direct fed bifilar helix antenna from said feed end;

providing that said outer planar surface portion of said bifilar antenna elements are separated by a second and third gap between said bifilar antenna elements, said first gap connecting with said second and third gap, said first gap comprising a first width and said second and third gap comprising a second width that varies with an axial position of said second and third gap along said tapered direct fed bifilar helix antenna, said second width being equal to said first width at said feed end of said tapered direct fed bifilar antenna, said second width increasing with increasing distance from said feed end until reaching a maximum width;

electrically connecting a single 50 ohm coaxial cable comprising a center conductor and an outer conductor to said pair of planar end surface portions at said feed point; and routing said 50 ohm coaxial cable being along said outer cylindrical shape of said tapered direct fed bifilar helix antenna in a helical path that follows and whose outer conductor is connected to one of said bifilar antenna elements to said opposite end of said antenna from said feed end.

7. The method of claim 6, comprising routing said coaxial cable away from said opposite end from a point on said antenna axis.

8. The method of claim 6, comprising providing that said maximum width of said second and third gap occurs at least one-half wavelength along the element's length away from said feed end.

* * * * *